United States Patent [19]

Dow

[11] 4,133,109

[45] Jan. 9, 1979

[54] RIBBON SLITTER

[76] Inventor: Robert E. Dow, 9 Pasadena Rd., Branford, Conn. 06405

[21] Appl. No.: 822,871

[22] Filed: Aug. 8, 1977

[51] Int. Cl.[2] ..... B26B 3/00

[52] U.S. Cl. ..... 30/279 R; 30/90.4; 30/304

[58] Field of Search ..... 30/279 R, 280, 282, 30/287, 304, 305, 90.1, 90.4

[56] References Cited

U.S. PATENT DOCUMENTS

| | | | |
|---|---|---|---|
| 2,082,524 | 6/1937 | Sell | 30/279 R |
| 2,220,169 | 11/1940 | Murdock | 30/279 R X |
| 2,323,863 | 7/1943 | Feemster | 30/279 R X |
| 2,443,873 | 6/1948 | Simpson | 30/279 R |
| 2,450,346 | 9/1948 | Krilow | 30/279 R |
| 2,450,347 | 9/1948 | Krilow | 30/279 R |
| 2,536,230 | 1/1951 | Sheppard | 30/279 R X |
| 2,547,249 | 4/1951 | Bell | 30/304 UX |
| 2,581,501 | 1/1952 | Shaver | 30/304 UX |
| 2,643,561 | 6/1953 | Ackley | 30/90.1 |
| 2,662,283 | 12/1953 | Gienger | 30/280 X |
| 3,552,016 | 1/1971 | Hittepole | 30/305 |
| 3,883,953 | 5/1975 | Saullo et al. | 30/304 |

FOREIGN PATENT DOCUMENTS

| | | | |
|---|---|---|---|
| 249038 | 3/1926 | United Kingdom | 30/305 |
| 281524 | 12/1927 | United Kingdom | 30/305 |
| 895442 | 5/1962 | United Kingdom | 30/90.4 |

*Primary Examiner*—Al Lawrence Smith
*Assistant Examiner*—J. T. Zatarga
*Attorney, Agent, or Firm*—DeLio and Montgomery

[57] ABSTRACT

A slitting device for subdividing longitudinally a ribbon wherein blades are mounted in a housing in positions to slit into two or more narrow strips a ribbon which is pushed endwise into a selected slot in the holder.

7 Claims, 4 Drawing Figures

RIBBON SLITTER

This invention relates to slitting devices and more particularly relates to a device for longitudinally slitting material in tape or ribbon form to obtain narrower strips.

Ribbons are commonly used in wrapping packages and making ornamental bows. In many cases, it is desired that a ribbon of a given width be used but only wider ribbons are available. The ribbons must then be cut by hand. Care must be taken when such cuts are made by scissors to cut parallel to the edges of the ribbon so that a ribbon of uniform width is obtained. Additionally, the ends of ribbons are sometimes slit into a plurality of widths for use in making bows, and to give a tassel effect.

The present invention provides a new and improved device of simplified construction which may be utilized to make one or more longitudinal slits in a ribbon and ensure uniform width of the sub-divided lengths.

Briefly stated, the invention in one form thereof comprises a housing having a plurality of partitions therein defining ribbon passages. The partitions further define pockets for blades which extend across one or more passages. The number and the location of the blades determine the number of strips that can be made from a ribbon as it is passed through one of the passages. The blades are mounted in the housing with the cutting edges recessed to ensure safety in use of the device.

It is an object of this invention to provide a ribbon or tape slitting device which can be used to make one or more slits in a ribbon of any desired length.

It is another object of this invention to provide a slitting device of simplified construction wherein the cutting elements may be easily replaced and the slitting elements may be readily available razor blades.

A further object of this invention is to provide a device of the type described where the cutting edges are completely within the outline of the housing to ensure safety in use.

The features of the invention which are believed to be novel are particularly pointed out and distinctly claimed in the concluding portion of this specification. The invention, however, may best be appreciated by reference to the following detailed description taken in conjunction with the drawings, in which:

Figure 1:
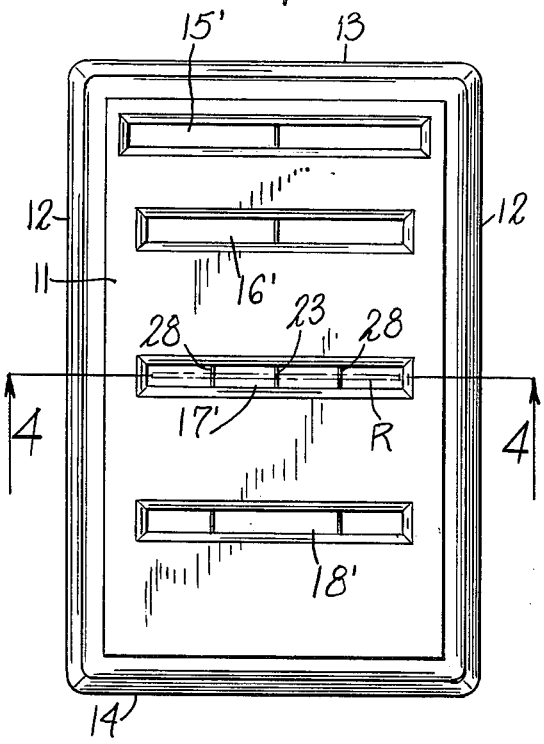
FIG. 1 represents a front elevation of the slitter.
Figure 2:
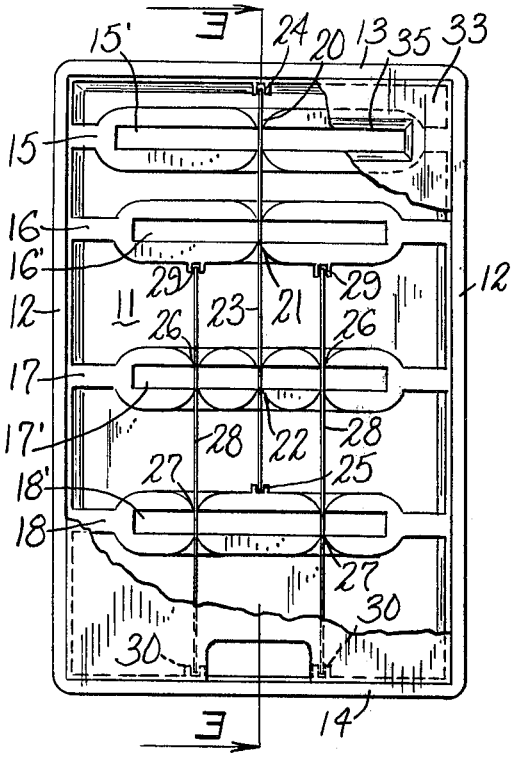
FIG. 2 represents a rear elevation with the back cover partly broken away.

Referring to the drawing, a slitting device comprises a housing shown as a rectangular box having a front wall 11, side walls 12 and end walls 13, 14. The interior is subdivided by four partitions 15, 16, 17 and 18, each of which has a double-walled central portion providing elongated flat passages 15', 16', 17' and 18', each of which extends through the front wall. The housing and partitions are preferably molded plastic.

In the arrangement shown, each of the partitions 15, 16 and 17 is centrally slotted at 20, 21 and 22 to about half of its depth to provide pockets which receive a single-edge razor blade 23, one end of which rests in a guide 24 on the end wall 13 and the other end of which rests in a similar guide 25 on the adjacent side of the partition 18. The cutting edges of the blades reside within the outline of the housing, and present no danger to the user.

The partition 17 is provided with two slots 26 spaced equally each side of the slot 22 and the partition 18 is also provided with two slots 27, aligned with slots 26, to receive two razor blades 28, each of which has one end in a guide 29 on the adjacent wall of partition 16 and its other end in a similar guide 30 on the end wall 14.

The blades 23 and 28 may suitably be single-edge razor blades of conventional shape and size, and the holder or housing is so proportioned that each blade has a friction fit in the position indicated, with the blade edges facing the front wall 11.

In the arrangement shown, each of the passages 15', 16' is bisected by the blade 23, the difference being that the passage 15' is slightly wider than the passage 16', to receive a wider ribbon. The passages 16', 17' and 18' are shown as being substantially equal in width, the passage 17' being traversed by all three blades, which divide the passage into quarters, and the passage 18' being traversed only by the two blades 28 which divide it into three parts of which the middle one is slightly wider.

The inner free edges of the side and end walls are rabbeted to engage the edges of the back cover 33 with a fairly tight friction fit, the cover being provided with openings 35, 36, 37 and 38 in positions to register with the passages 15', 16', 17' and 18'.

Figure 3:
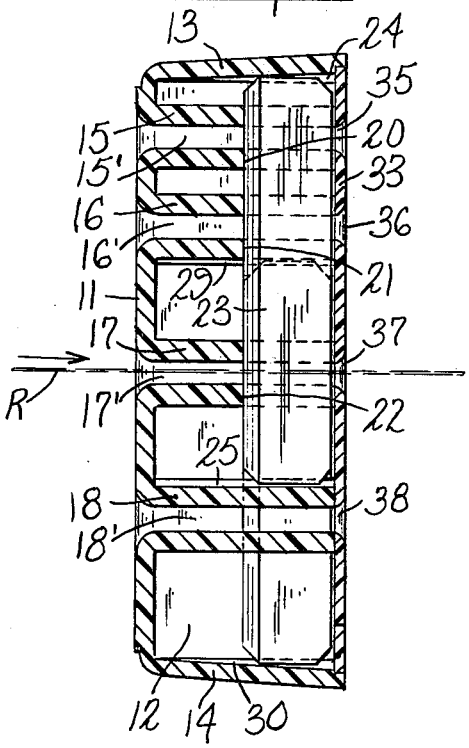
FIG. 3 represents a section on the line 3—3 of FIG. 2.
Figure 4:
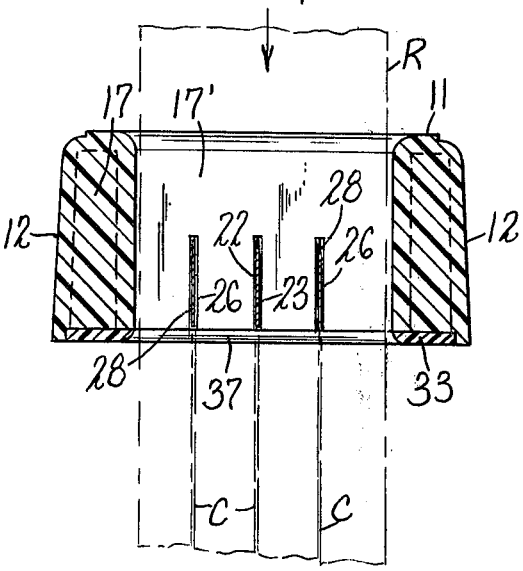
FIG. 4 represents a section on the line 4—4 of FIG. 1.

In operation, the end of a ribbon, indicated at R in FIGS. 3 and 4, is introduced into a selected passage and forced firmly against the edge or edges of the blade or blades in the respective passage to form the longitudinal cuts C. It has been determined that many of the ornamental ribbons used in certain types of packaging and the like are sufficiently self-supporting to be cut satisfactorily in this manner. The end of the ribbon may be cut on a bias and the leading apex first inserted past the cutter, so that it may be more easily pulled through a passage. If desired the slitter could be made up with more or less than four passages, and in different sizes and shapes, but the device as shown is proved to be convenient and sufficiently adaptable.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

What is claimed is:

1. A device for slitting ribbon material of a first width into a plurality of ribbon strips of lesser width comprising, a body member defining a plurality of ribbon receiving passages therethrough, a plurality of blades having cutting edges supported in said body member and traversing said passages so as to provide different numbers of cutting edges in different ones of said passages, whereby ribbon may be slit into various pluralities of ribbin strips of lesser width than the original material by passing the original material through selected ones of said passages, each of said blades traversing more than one passage.

2. The device of claim 1 wherein said housing member has integral partitions defining said passages, and pockets integrally defined in said housing for said blades to position the blades across said passages.

3. The device of claim 1 wherein said passages are four in number, and three blades are provided, all three of said blades extending across at least two of said passages.

4. The device of claim 1 wherein said housing member is molded plastic, a plurality of integral partitions extending across said housing and defining said ribbon-receiving passages, and pockets defined in said partitions for positioning said blades across said passages.

5. A device for slitting material in ribbon form comprising a housing member having a front portion and a back portion, said portions cooperating to constitute a closed box having front and back walls, a plurality of parallel partitions integral with one of said portions, each said partition being traversed by a flat passage wide enough to receive a ribbon to be slitted, each partition being provided with at least one slot substantially perpendicular to the plane of the respective partition, and blades having slitting edges positioned in at least two of said slots in adjacent partitions with the slitting edges traversing the passages in said partitions in a position to slit the end of a ribbon-like material as it is passed through one of said passages, said blades presenting different numbers of slitting edges in different ones of said passages with each blade traversing more than one passage.

6. A device according to claim 5 wherein said partitions and passages are four in number and three blades are provided, each blade extending across at least two passages.

7. A device according to claim 5 wherein the box has end walls and guides are provided on a side surface of a partition and on at least one end wall of the box to receive and support the ends of at least one blade.

* * * * *